United States Patent [19]

Piljay et al.

[11] 4,437,462

[45] Mar. 20, 1984

[54] PNEUMATIC HEAD HARNESS

[75] Inventors: Robert E. Piljay, Alden; Loyal G. Netteland, Holland, both of N.Y.

[73] Assignee: Figgie International Inc., Willoughby, Ohio

[21] Appl. No.: 322,775

[22] Filed: Nov. 19, 1981

[51] Int. Cl.[3] ..... A67B 18/08

[52] U.S. Cl. ..... 128/207

[58] Field of Search ..... 128/205.25, 206.21, 128/206.27, 201.28, 207.11

[56] References Cited

U.S. PATENT DOCUMENTS 3,013,556 12/1961 Galliher, Jr. ..... 128/207.11

3,599,636 8/1971 Gutman et al. ..... 128/207.11

FOREIGN PATENT DOCUMENTS 826198 12/1959 United Kingdom ..... 128/207.11

*Primary Examiner*—William E. Kamm

*Attorney, Agent, or Firm*—Christel, Bean & Linihan

[57] ABSTRACT

An inflatable head harness for quickly orienting and securing a device, such as a respiratory mask, in position on the head of a user. The harness comprises a loop to fit around the head, the loop having a longitudinally elastically extensible outer tube and a folded, inflatable, substantially inelastic inner tube positioned within the outer. The inner tube has a greater length than the outer tube and is positioned therein in folded or pleated form. The inner tube is enlarged by means of pressurized fluid, causing the outer tube to extend longitudinally to thereby increase the diameter of the loop and enable it to be slipped over the head. When the pressure is released, the elasticity of the outer tube causes it to contract longitudinally so that the loop is in gripping engagement with the head of the user.

16 Claims, 4 Drawing Figures

PNEUMATIC HEAD HARNESS

DESCRIPTION

1. Technical Field

This invention relates to head harnesses, and more particularly to an inflatable head harness adapted for rapid and secure attachment to the head of the user and requiring the use of only one hand.

2. Background Art

Head harnesses are commonly utilized to hold in position any of a number of devices, such as, for example, miners' lamps, doctors' examining lamps, and respiratory masks utilized by crew members of high altitude aircraft. Although for many applications a simple elastic band attached to the article to be secured to the head of the user is sufficient, there are times, particularly in connection with respiratory masks typically worn by aircraft crew members, when rapid and sure attachment of a head-mounted device must be effected, and it must be capable of being attached on a one-handed basis, since the user's other hand is frequently occupied in some other essential task. For example, if because of a pressurization failure, the pilot of an aircraft is required rapidly to don his respiratory mask to provide the necessary oxygen for breathing, he often must do so with one hand while his other hand is occupied in controlling the aircraft. Thus, the use of an inflatable head harness has been suggested in order to permit the respiratory mask to be donned using only one hand. The head harness is expanded diametrically by the introduction of pressurized gas to cause the harness to increase in size so that it can be positioned over the head of the user. The flow of the gas is controlled by a valve attached to the respiratory mask, and after enlargement the respiratory mask is placed in position over the nose and mouth, with the head harness extended over and spaced from the back of the head. Once the respiratory mask has been properly positioned, the pressure in the head harness is released, causing the harness to contract and to contact the head of the pilot, whereby the respiratory mask is securely held in its proper position. Meanwhile, the pilot's other hand is free to control the aircraft or to perform such other tasks as may be required.

An inflatable head harness is shown and described in U.S. Pat. No. 3,599,636 in which the harness is defined by a pair of spaced, expandable rubber tubes which are housed within an outer casing of material which has limited yieldability and which is initially in pleated form. However, the head harness shown in that patent involves a structure wherein the retention function and inflation function are embodied in a single element, a rubber, tubular element. Although such an arrangement will function satisfactorily so long as the integrity of the rubber tubular element is unimpaired, if that element should become punctured, the puncture will readily propagate through the rubber, thereby rendering the tubular element incapable of holding the pressurized gas and therefore incapable of being inflated. Additionally, if stretched manually, the puncture could propagate to the point where the rubber tubular element could rupture completely, rendering the entire device inoperable.

DISCLOSURE OF INVENTION

It is an object of the present invention to provide an improved inflatable head harness having an inner inflatable tube and an outer tube, and wherein the inner, inflatable tube is of substantially non-elastic material, so that punctures therein do not render the harness inoperable.

It is another object of the present invention to provide an inflatable head harness one method of use wherein the retention function is provided by a separate element from that which permits the inflation of the device.

It is a further object of the present invention to provide an inflatable head harness in which the inner inflatable tube is made from a material which does not permit the propagation and enlargement of ruptures and pinholes.

Briefly stated, in accordance with one aspect of the present invention, an inflatable head harness is provided for securely holding in position a device intended to be secured to the head of the user. The harness includes at least one extensible tubular member in the form of a loop, which is adapted to encircle the head of the user. The extensible tubular member includes a longitudinally elastically extensible outer tube and an inflatable inner tube positioned within the outer tube, the inner tube being substantially inelastic in comparison with the outer tube. The device includes valve means connectable to a source of pressurized fluid, the valve means being adapted to control the admission to and the discharge from the inner tube of pressurized fluid, in order to selectively circumferentially expand and contract the harness, as necessary, for application over the head of the user and subsequent securement of the device in its proper operating position.

BEST MODE FOR CARRYING OUT THE INVENTION

Figure 1:
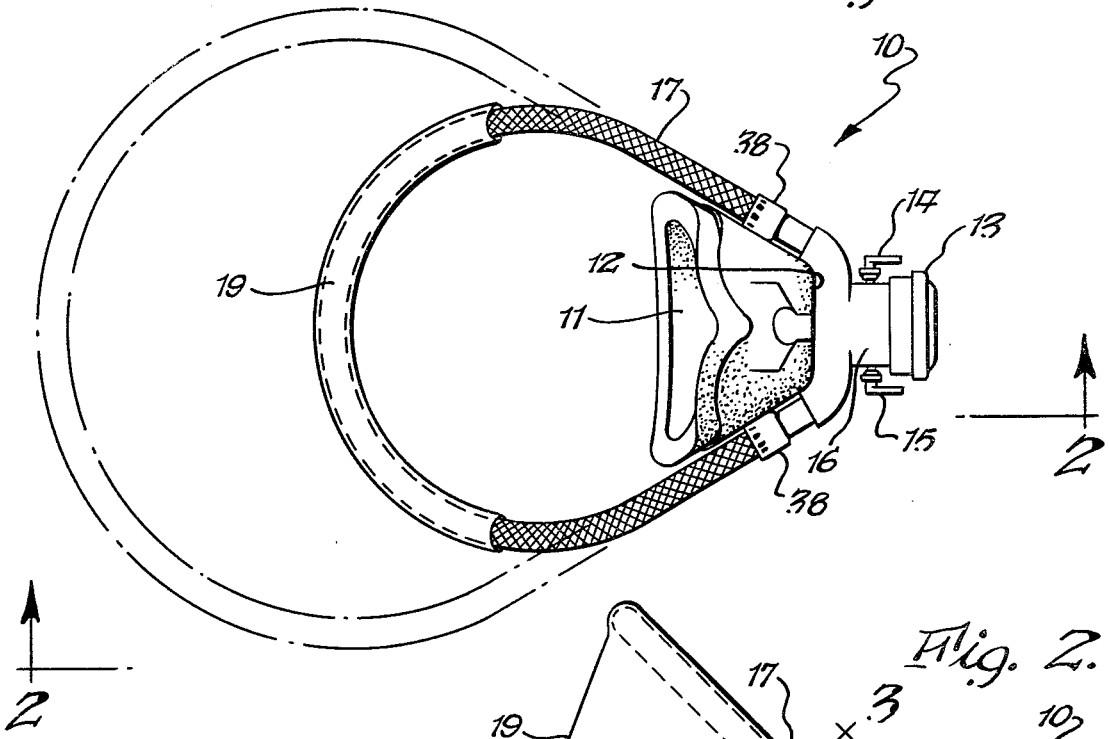
FIG. 1 is a top view of an inflatable head harness in accordance with the present invention, secured to and adapted to hold in position a respiratory mask, the head harness shown in uninflated, relaxed condition in solid lines, and in inflated, expanded condition in phantom.

Referring now to the drawings and particularly to FIG. 1 thereof, there is shown a head harness as utilized in conjunction with a respiratory mask 10, which can be of the type intended to provide oxygen to aircraft crew members under high altitude conditions or under conditions in which the aircraft cabin pressurization has for some reason been lost. Although shown and described herein in the context of a respiratory mask, the head harness of the present invention can be utilized in other applications where one-handed donning of a head-held device is required, and it should be appreciated that its use in conjunction with a respiratory mask is illustrative only, and not limiting.

Mask 10 includes a flexible, generally cup-shaped face member 11 adapted to fit over and cover the mouth and nose of the user, and which is suitably shaped to provide a comfortable fit. Positioned at the forward outer end 12 of face member 11 is a control valve 13 having a slidable valve member 14, 15 positioned on each side of control valve 13, each of which is adapted to selectively open and close a passageway to admit a pressurized fluid to the harness structure, as will hereinafter be described. Control valve 13 can be a two-position valve, wherein in one position it permits communication between the head harness and the atmosphere while it simultaneously prevents the entry of pressurized gas to the harness, and in a second position it prevents communication with the atmosphere and admits pressurized gas to the harness structure. As is apparent, control valve 13 is adapted for one-handed use, thereby permitting the other hand of the user to be occupied with other tasks. Although a specific structure of control valve is shown and described, it will be apparent to those skilled in the art that other types of control valve structures could also be successfully utilized together with the head harness structure of the present invention, and the control valve structure shown is for illustrative purposes only.

Figure 2:
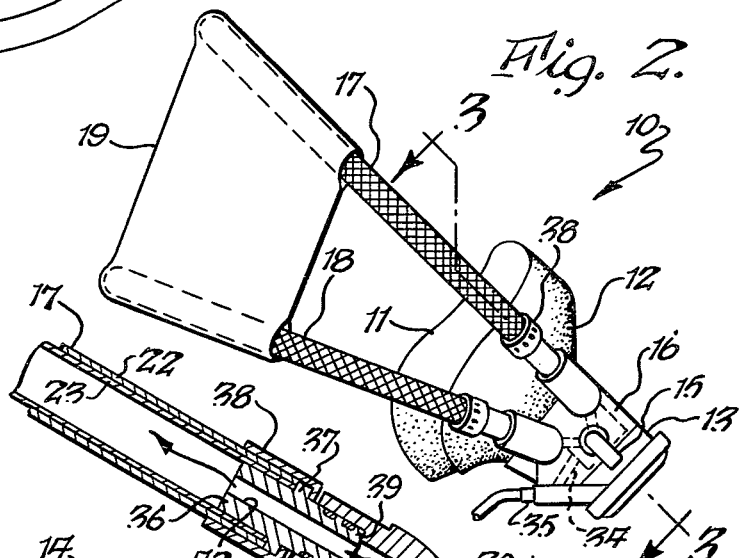
FIG. 2 is a side view of the head harness and respiratory mask shown in FIG. 1.

Control valve 13 shown includes a valve housing 16, which fits over and is secured to forward portion 12 of face member 11, and to which is attached at least one tubular member 17 in the form of a loop, each end of which is securely received in housing 16 in substantially gas-tight relationship. Tubular member 17 is adapted to encircle the head of the user and when properly positioned it securely holds face member 11 in its operative position. In its preferred form, the head harness of the present invention includes two tubular elements 17, 18 (see FIG. 2) with a spacer member 19 therebetween to hold tubular elements 17, 18 in a predetermined, spaced angular relationship relative to each other for maximum comfort on the part of the user. Although shown as having two tubular members 17, 18, the benefits of the present invention are obtainable when merely one tubular member is utilized, and although the ensuing description will be with reference to tubular member 17, it will be appreciated that the construction and operation of tubular member 18 are identical with those of tubular member 17.

Figure 3:
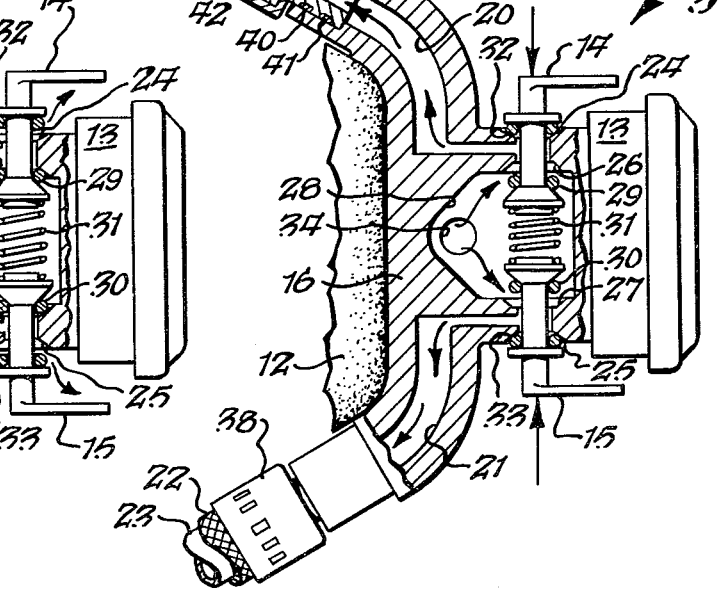
FIG. 3 is a fragmentary, cross-sectional view taken along the line 3—3 of FIG. 2 and showing the operative components of the harness when it is in its uninflated, relaxed position.

Referring now to FIG. 3, there is shown the interconnection between tubular member 17 and valve housing 16. A pair of tubular passageways 20, 21 are provided in valve housing 16 to permit communication between the ends of tubular member 17 and the interior of valve housing 16 to either admit pressurized fluid thereto or to vent the interior of tubular member 17 to the atmosphere. Tubular member 17 includes a first, outer tube 22 and a second, inner tube 23. Outer tube 22 is made from an elastic material which is elastically extensible in an axial or longitudinal direction, but which need not be elastically extensible in a radial or transverse direction. The purpose of the longitudinal extensibility is to permit axial extension of tubular member 22 to enable its placement over the head of the user, and subsequently to permit it to contract into closely fitting engagement with the user's head to hold the device to which it is applied in its proper position. A preferred material from which outer tube 22 can be formed is woven cloth with intermediately woven bands of rubber and nylon yarn. The nylon adds strength to the structure and the rubber permits its elastic extension. Preferably, the degree of extensibility of outer tube 22 is about 175% of its original length to permit the device to be utilized with a large range of head sizes, although the device will function adequately to permit the harness to be looped over the user's head and accommodate a smaller range of head sizes if the minimum degree of extensibility is of the order of about 110% of the original length. Additionally, outer tube 22 can be fluid impermeable, but it need not have that capability since the invention is intended to function utilizing only an inner fluid impermeable tube.

Inner tube 23 fits completely within outer tube 22 and is formed from a fluid impermeable material, preferably a tightly woven fabric which exhibits high strength, high resistance to puncture damage, and chemical inertness. Examples of suitable materials are woven parachute silk and woven nylon fabric, although other tightly woven fabric material meeting the above-identified criteria could also be used. The tightly woven material provides the desirable resistance to rupture propagation; fluid impermeability is provided by a coating which can be a thermoplastic material such as, for example, polyurethane. The coating can also be such as to permit the inner tube material to be either heat sealed or otherwise bonded to itself.

Preferably, inner tube 23 is substantially inelastic, and is formed from two narrow ribbons of coated woven fabric which are heat sealed or bonded together along their respective marginal edges to define a flat, tubular member. If desired, inner tube 23 can also be formed from a single ribbon of coated material which can be folded over upon itself and the outer edges thereof bonded together to provide a tubular member having only one seam.

As shown in FIG. 3, inner tube 23 when not inflated is in folded or pleated form, such as the generally serpentine form shown, so that when it is inflated and extended to its unfolded or unpleated length it has a greater length than outer tube 22 within which it is positioned. Preferably, the relative unpleated length of the inner tube to that of the relaxed, unextended outer tube is about 175%. If the unpleated length of inner tube 23 is significantly greater than, say, 200% of the length of outer tube 22, the fluid pressure may expand the harness to an unnecessarily large size, thereby lengthening the time for the application process and possibly endangering the user by drawing his attention away from more pressing matters. Additionally, the cross-sectional diameter of inner tube 23 when inflated is preferably greater than the cross-sectional diameter of outer tube 22 so that the latter constricts the size of the former to provide a counter pressure therein and thereby reduce the loads on the seams.

As also shown in FIG. 3, valve housing 16 can carry a pair of opposed, slidable valve actuating members 14, 15, which, as shown, are spring biased outwardly by means of compression spring 31, thereby permitting communication between passageways 20, 21 and the ambient atmosphere through outlets 24, 25, respectively. When slidable members 14 and 15 are in the positions shown in FIG. 3, apertures 26 and 27 are closed off by sealing rings 29, 30, respectively, thereby preventing communication between passageways 20, 21 and valve chamber 28.

Figure 4:
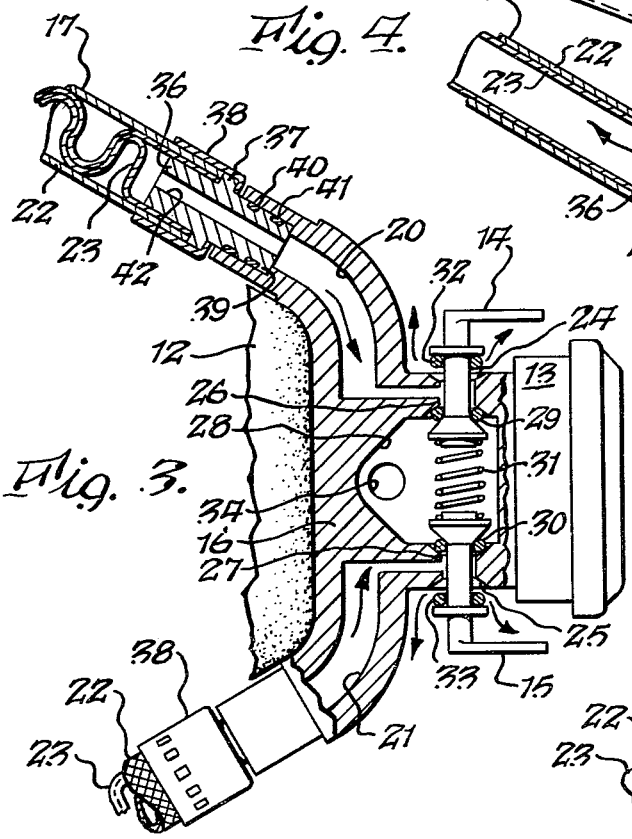
FIG. 4 is a fragmentary, cross-sectional view similar to that of FIG. 3, but showing the operative components of the harness when it is in its inflated, expanded condition.

Referring now to FIG. 4, the head harness is shown in inflated form by virtue of the introduction of pressurized fluid, which has caused inner tube 23 to become inflated, whereupon it has unfolded and extended to its full length. Simultaneously, inner tube 23 has caused outer tube 22 to stretch longitudinally, while outer tube 22 has constricted the cross-sectional size of inner tube 23, thereby reducing the loads in the marginal seams thereof. The relative difference in longitudinal extent of tubular member 17 in its unexpanded, relaxed state as compared with its longitudinal extent in its expanded, pressurized state is illustrated in FIG. 1, wherein the relaxed, unpressurized state is shown in solid lines, while the expanded, pressurized state is shown in phantom.

As also shown in FIG. 4, the pressurized fluid to inflate inner tube 23 can be admitted through valve housing 16 and is controlled by slidable members 14 and 15. As shown in FIG. 4, slidable members 14 and 15 have been moved inwardly against the force of compression spring 31 and outlets 24, 25 to the ambient atmosphere have been closed by sealing rings 32, 33 respectively. At the same time, the inward movement of sealing rings 29, 30 have opened apertures 26, 27, respectively, permitting communication between passageways 20, 21 and valve chamber 28. A source of pressurized fluid is in communication with valve chamber 28 through passageway 34, which extends to inlet connection 35 (see FIG. 2).

Tubular member 17 and 18 can be attached to valve housing 16 as shown in FIGS. 3 and 4. Although the description which follows will be confined to the connection between one end of tubular member 17 and passageway 20 of valve housing 16, it will be apparent that the same connection arrangement can be employed for the other connections between tubular members 17, 18 and valve housing 16.

An end of each of inner and outer tubes 22, 23 is slip fitted over outer cylindrical end 36 of union 37 and an outer sleeve 38 is crimped in position thereover to provide a tight fitting and gas-tight connection therebetween. The inner cylindrical end 39 is inserted into passageway 20 and can be secured therein by means of an interference fit or by other retaining means (not shown). If desired, flexible sealing rings 40, 41 can be provided to insure that the interconnection is fluid tight. A through bore 42 is provided in union 37 to provide communication between passageway 20 and the interior of inner tube 23.

In operation, the user grasps valve housing 16 with his thumb and index finger over the ends of slidable members 14 and 15. Valve housing 16 is in communication with a source of pressurized fluid through inlet connection 35. The user presses inwardly on slidable members 14 and 15 to thereby actuate the valve to admit the pressurized fluid into inner tube 23, thereby inflating it and expanding it to its maximum length, while simultaneously expanding outer tube 22, the degree of expansion of outer tube 22 being controlled by the length of inner tube 23, and also dependent to a certain extent upon the extensibility of outer tube 22. After inflation, the head harness is slipped over the head and the respiratory mask or other device placed in a proper and comfortable operating position. Once the device has been properly positioned, the inward pressure exerted on slidable members 14 and 15 by the thumb and index finger of the user is released, permitting spring 31 to move slidable members 14 and 15 from the positions in which they are shown in FIG. 4 to the positions in which they are shown in FIG. 3, wherein communication with the pressurized fluid source is blocked and the pressurized fluid within inner tube 23 is vented to the atmosphere. When that release of pressure occurs, the longitudinal elasticity of outer tube 22 causes the harness loop to contract and to come into gripping contact with the user's head to securely hold the device in position. As will be appreciated, all the foregoing steps can be accomplished by the use merely of one hand, thereby permitting the user's remaining hand to be occupied in other tasks.

Because inner tube 23 is formed from a woven reinforced material, and because it is protected by the outer tube 22, there is less opportunity for damage to occur to inner tube 23, thereby protecting the integrity of the device. Similarly, if inner tube 23 should for some reason become disconnected from the pressure source, should the pressure source fail, or should inner tube 23 become punctured, the elasticity of outer tube 22 will still permit the device to be secured to the head of the user, although not as conveniently and possibly requiring the use of two hands to stretch outer tube 22 to permit it to be slipped over the user's head. Thus, the invention is intended to include a fail-safe feature, so that the harness is manually operable even if pressurization of the inner tube cannot be effected.

As is apparent, the head harness of the present invention does not require a separate adjustment, the purpose of which would be to vary the initial, relaxed length of the loop. The degree of extension provided with the present invention is such as to permit the convenient use of the device over a range of head sizes.

While particular embodiments of the invention have been illustrated and described, it will be apparent to those skilled in the art that various changes and modifications can be made, and it is intended to cover in the appended claims all such changes and modifications that fall within the scope of the present invention.

We claim:

1. An inflatable head harness for holding a device in position on the head of a user, said harness comprising:

(a) at least one extensible tubular member in the form of a loop, said extensible tubular member including a longitudinally elastically extensible outer tube and an inflatable inner tube positioned within said outer tube, said inner tube being substantially inelastic in comparison with said outer tube; and (b) means connectable to a source of pressurized fluid to permit the admission to and discharge from said tubular member of pressurized fluid to selectively increase and decrease the diameter of said loop.

2. The head harness of claim 1 wherein said inner tube is longer than said outer tube when said outer tube is in relaxed, unextended condition.

3. The head harness of claim 2 wherein at least a portion of said inner tube is pleated.

4. The head harness of claim 3 wherein said inner tube in its unpleated, fully extended length is about 175% of its pleated, uninflated length.

5. The head harness of claim 2 wherein said inner tube is formed from a woven fabric material.

6. The head harness of claim 5 wherein said woven fabric material includes a coating whereby to permit said inner tube to be formed utilizing at least one bonded seam.

7. The head harness of claim 6 wherein said inner tube has a greater cross-sectional diameter when inflated than that of said outer tube to minimize the stress in said bonded seam.

8. The head harness of claim 1 wherein said outer tube is extensible in a longitudinal direction by at least out 110%.

9. The head harness of claim 5 wherein said outer tube is longitudinally extensible to a length of about 175% of its length in relaxed, unextended condition.

10. The head harness of claim 1 wherein said harness includes two tubular members in loop form, each tubular member defining a plane, the two planes defined by said tubular members arranged at an acute angle, and a spacer member for holding said loops in predetermined angular relationship.

11. The head harness of claim 10 wherein said spacer member is in contact with less than about 50% of the periphery of said tubular members when the same are in relaxed, unexpanded condition.

12. An inflatable and extensible tubular member for attaching and securing a device in a predetermined position, said tubular member comprising:

(a) a longitudinally extensible outer tube having limited radial extensibility; and (b) an inner tube positioned within said outer tube, said inner tube being substantially inelastic in comparison with said outer tube having a length greater than the length of said outer tube when said outer tube is in relaxed, unextended position.

13. The tubular member of claim 12 wherein said inner tube is formed from a woven fabric material.

14. The tubular member of claim 13 wherein said woven fabric material includes a coating, whereby to permit said inner tube to be formed utilizing at least one bonded seam.

15. The tubular member of claim 14 wherein said inner tube has a greater cross-sectional diameter when inflated than that of said outer tube to minimize the stresses in said bonded seam.

16. A method of one-handedly orienting and securing a device to be positioned on the head of a user by means of an inflatable loop attached to said device, said method comprising:

(a) providing an extensible loop including a longitudinally elastically extensible outer tube and a folded, inflatable, substantially inelastic inner tube positioned within said outer tube, said inner tube having a greater unfolded length than said outer tube when said outer tube is in relaxed, unextended condition;

(b) unfolding said inner tube by introducing pressurized fluid to the interior thereof to longitudinally extend said inner tube to an inflated condition wherein said inner tube assumes a fixed maximum cross-sectional diameter defined solely by the size of said inner tube, whereby to longitudinally extend said outer tube to increase the diameter of said loop;

(c) placing said loop over the user's head to permit placement of said device in a preferred position; and (d) causing said loop to contract by releasing pressurized fluid from said inner tube, whereby said loop is in secure engagement with the head of the user.

* * * * *